US006520244B2

(12) United States Patent
Lapeus et al.

(10) Patent No.: US 6,520,244 B2
(45) Date of Patent: Feb. 18, 2003

(54) METHOD AND APPARATUS FOR CURING FOUNDRY CORES

(75) Inventors: James R. Lapeus, Aurora, OH (US); Michael John Braskich, Grosse Ile, MI (US); Mark John Gallo, Canton, MI (US); Robert W. Grenkowitz, Washington, MI (US); Stephen A. Veresh, Dearborn, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/681,291

(22) Filed: Mar. 14, 2001

(65) Prior Publication Data

US 2002/0129915 A1 Sep. 19, 2002

(51) Int. Cl.[7] ..... B22C 9/00; B22C 7/06

(52) U.S. Cl. ..... 164/228; 164/234; 164/16

(58) Field of Search ..... 164/16, 159, 456, 164/228, 234

(56) References Cited

U.S. PATENT DOCUMENTS 5,325,909 A * 7/1994 Unterderweide ..... 164/16
5,924,475 A * 7/1999 Beckwith et al. ..... 164/16
5,971,056 A * 10/1999 Bovens ..... 164/16

* cited by examiner

*Primary Examiner*—Tom Dunn
*Assistant Examiner*—I.-H. Lin
(74) *Attorney, Agent, or Firm*—Damian Porcari

(57) ABSTRACT

An apparatus for curing foundry cores 100 is provided, including a first curing agent supply 110 passing through foundry core 145 primarily through first directional plane 130 and a secondary curing agent supply 160 passing through the foundry core 145 primarily through a secondary directional plane 170.

8 Claims, 1 Drawing Sheet

METHOD AND APPARATUS FOR CURING FOUNDRY CORES

BACKGROUND OF THE INVENTION

The present invention relates generally to a method and apparatus for curing foundry cores and more particularly to a method and apparatus for curing foundry cores with reduced curing time.

The use of foundry cores in forming metals and other substances into useful products is well known in the prior art. These cores are commonly formed by injecting material into a core cavity formed in a core box tool. Although the cores may be created through a variety of processes, one known method is to form the core, often an aggregate-binder mixture, and then cure the core in order to give it proper hardness, dimensional stability, and robustness.

Although the curing of foundry cores may be accomplished through a variety of methods, one known method uses a curing agent, often gaseous, to properly cure the core material. One common method allows the curing agent to pass through the core cavity and the core aggregate material contained therein. The curing agent passes from a gas entry port, through the aggregate in the core cavity, and exits at the bottom of the core cavity. After exiting the bottom of the core cavity, the curing agent can be directed to exhaust ports, positioned in the core box tool through the use of negative air or other processes (see FIG. 1).

Although present gas curing methods can provide cost benefits over heat curing methods, there is still room for improvements in the reduction of curing time. Reductions in curing time can allow a larger number of foundry cores to be produced. In addition, reductions in curing time can potentially result in reduced production costs and improved core quality production efficiency. It would, therefore, be desirable to have an apparatus and method for curing foundry cores that can potentially reduce the time required to cure the cores and improve curing efficiency.

SUMMARY OF INVENTION

In accordance with the objects of the present invention, an apparatus and method for curing foundry cores is provided. The apparatus includes a first curing agent source flowing the curing agent through the foundry core primarily in a first direction. The apparatus further includes at least one secondary curing agent source flowing the curing agent through the foundry core in a secondary direction, not coincident with the first direction.

Other objects and features of the present invention will become apparent when viewed in light of the detailed description of the preferred embodiment when taken in conjunction with the attached drawings and appended claims.

DETAILED DESCRIPTION

Figure 1:
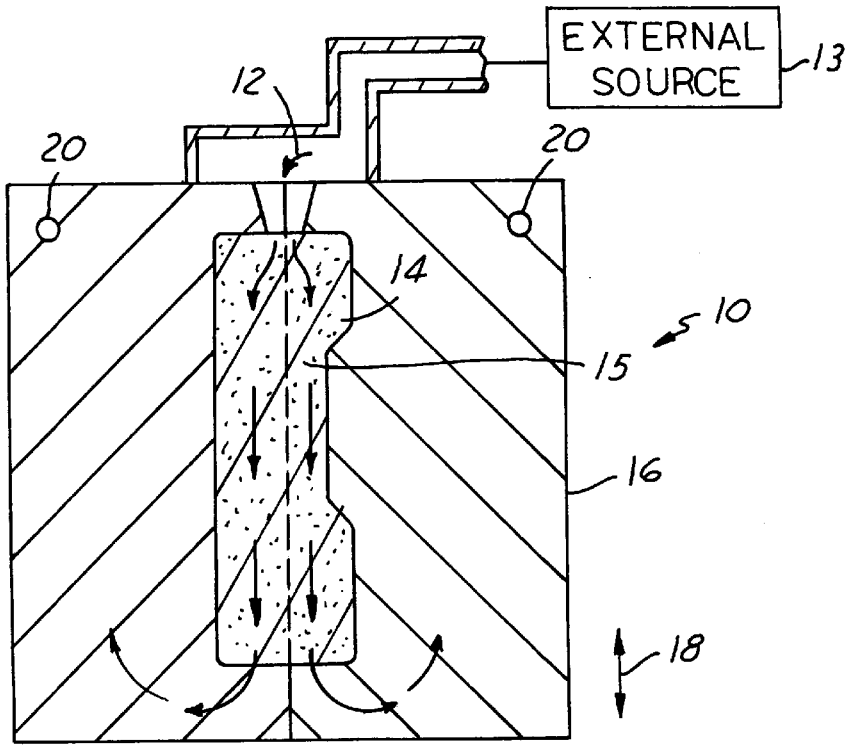
(PRIOR ART) FIG. 1
FIG. 1 is a cross-sectional illustration of an embodiment of an apparatus for curing foundry cores as is known in the prior art.

Referring now to FIG. 1, which is a cross-sectional illustration of an embodiment of an apparatus for curing foundry cores in accordance with the prior art. Although a variety of methods of curing are known in the prior art, one version, a vertical curing apparatus, is shown for illustrative purposes. The known gas curing apparatus 10 supplies a curing agent 12, often from an external source 13, to the core cavity 14 containing the foundry core 15. The curing agent 12 flows down through the foundry core 15 in a primarily direction 18. The gas curing agent 12 then flows through the core box tool 16 and exits through exhaust ports 20. Although this is a known and successful method for curing foundry cores, this known curing apparatus 10 still leaves room for improvement.

Figure 2:
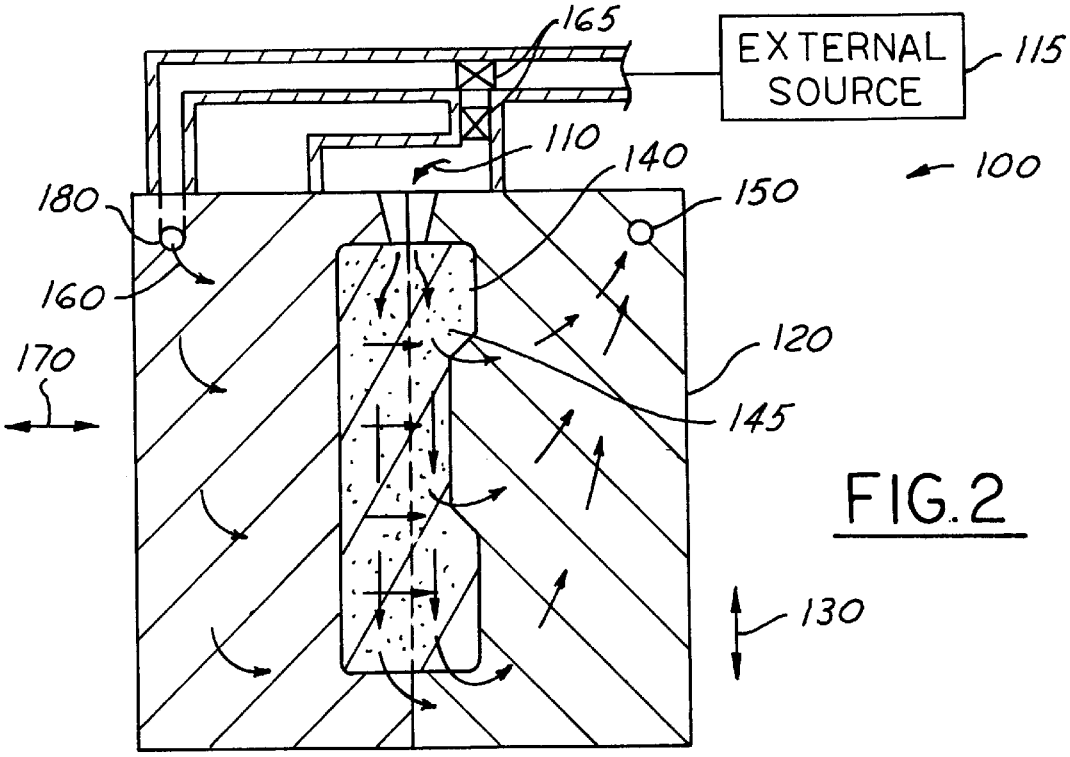
FIG. 2 is a cross-sectional illustration of an embodiment of an apparatus and method for curing foundry cores in accordance with the present invention.

Referring now to FIG. 2 which is a cross-sectional illustration of an embodiment of an apparatus and method of curing foundry cores 100 in accordance with the present invention. The apparatus and method of curing foundry cores 100 includes a first supply of a curing agent 110 introduced into the core box tool 120. In one embodiment, the first supply of curing agent 110 is a gas although a wide variety of curing agents 110 are contemplated. Furthermore, in one embodiment, the first supply of curing agent 110 is provided from an external source 115, although a variety of methods for providing curing agents are known in the prior art.

The first supply of a curing agent 110 passes through the core cavity 140 and the foundry core 145 positioned therein primarily in a first direction 130. The first direction 130 is illustrated as coincidental with the primary axis 131 of the core cavity 140. The first supply of curing agent 110 enters the core cavity 140 in the core box tool 120 and passes through the foundry core 145 similar to the prior art. Although the first supply of the curing agent 110 has been illustrated passing through the foundry core 145 in a direction similar to that of the prior art, it should be understood that the first direction 130 can be any direction through the foundry core 145. Furthermore, it should be understood that the use of the term "direction" within this application only refers to a general direction of flow of the curing agent. The flow of the curing agent 110 as it passes through the material of the foundry core 145 can only be said to flow generally in any specific direction. The first supply of curing agent 110 exits through an exhaust port 150 after passing through the core box tool 120.

The apparatus and method of curing foundry cores 100 further includes at least one secondary supply of curing agent 160. In one form of the present invention, the secondary supply of curing agent 160 is a gaseous agent supplied from an external source 115 although other curing agent forms and supply configurations are possible. Additionally, the first supply of curing agent 110 and the secondary supply of curing agent 160 can be adjustable using adjustable flow devices 165, although a wide variety of methods of controlling the flow of the curing agent 110, 160, including non-adjustable flow, 110, 160 are contemplated.

The secondary supply of curing agent 160 flows through the foundry core 145 primarily in a secondary direction 170. In one embodiment, the secondary supply of curing agent 160 passes through the foundry core 145 simultaneously with the first supply of curing agent 110, although in other embodiments the flows may be stepped, pulsed, alternated, or a host of other configurations. Although a variety of methods of introducing a secondary supply of curing agent 160 to the foundry core 145 are contemplated, the illustrated embodiment shows a secondary supply of curing agent 160 supplied through an intake port 180 positioned remotely from the core cavity 140. The secondary supply of curing agent 160 passes through the core box tool 120 and the foundry core 145 and exits through an exhaust port 150. It should be understood that the use, number, and position of intake ports 180 and exhaust ports 150 may be varied and modified in alternate embodiments. By flowing the gas curing agent 110, 160 through the foundry core 145 through differing directions, it has been found that the time required to cure the foundry core 145 can be reduced.

Although in one embodiment, the first direction 130 and the secondary direction 170 are approximately perpendicular to each other, it should be understood that a wide variety of different directions are contemplated. In addition, in alternate embodiments, additional directional planes and additional curing agent supplies (not shown) may be used in addition to the first and second directions 130, 170 and the first and second curing agent supplies 110, 160. The number and position of gas inlets and outlets may also be varied to accommodate varying numbers and directions of gas curing directions.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. An apparatus for curing foundry cores comprising:

a first curing agent supply, said first curing agent supply entering a core box tool through a core cavity at a top of said core box tool, said first curing agent supply passing through the foundry core primarily in a first direction, said first direction generally coincidental with a primary axis of the foundry core; and a second curing agent supply, said second curing agent supply entering said core box tool primarily through an intake port positioned on a side of said core box tool, said secondary curing agent supply passing through the foundry core primarily in a secondary direction. Said secondary direction non-coincidental with said first direction.

2. An apparatus for curing a foundry core as described in claim 1 wherein said first curing agent supply and said second curing agent supply are a gas.

3. An apparatus for curing a foundry core as described in claim 1 further comprising:

at least one additional curing agent supply flowing through the foundry core in at least one additional direction.

4. An apparatus for curing foundry cores as described in claim 1 wherein said first direction and said second direction are approximately perpendicular to each other.

5. An apparatus for curing a foundry core as described in claim 1 for use on vertically parted foundry cores.

6. An apparatus for curing a foundry core as described in claim 1 further comprising at least one exhaust port.

7. An apparatus for curing a foundry core as described in claim 1 wherein said first curing agent supply and said second curing supply exit through a single exhaust port.

8. An apparatus for curing a foundry core as described in claim 1 wherein said first curing agent supply and said second curing agent supply exit through a plurality of exhaust ports.

* * * * *